343-700 MS AU 251 EX

12/18/84 OR 4,489,328

United States Patent [19]

Gears

[11] Patent Number: 4,489,328

[45] Date of Patent: Dec. 18, 1984

[54] PLURAL MICROSTRIP SLOT ANTENNA

[76] Inventor: Trevor Gears, 10 Tannery Yard, Witney St., Burford, Oxfordshire OX8 4DN, England

[21] Appl. No.: 390,613

[22] Filed: Jun. 21, 1982

[30] Foreign Application Priority Data

Jun. 25, 1981 [GB] United Kingdom ..... 8119623

[51] Int. Cl.[3] ..... H01Q 1/38; H01Q 13/10

[52] U.S. Cl. ..... 343/700 MS; 343/770

[58] Field of Search ..... 343/770, 700 MS, 767, 343/768, 746, 769, 789, 12 A, 845-848

[56] References Cited

U.S. PATENT DOCUMENTS 3,757,344 9/1973 Pereda ..... 343/770
4,191,959 3/1980 Kerr ..... 343/700 MS
4,242,685 12/1980 Sanford ..... 343/770

FOREIGN PATENT DOCUMENTS 1364941 8/1974 United Kingdom .
1434475 5/1976 United Kingdom .
1470884 4/1977 United Kingdom .
1532731 11/1978 United Kingdom .
1546571 5/1979 United Kingdom .
1572273 7/1980 United Kingdom .
2067842 7/1981 United Kingdom .
2074792 11/1981 United Kingdom ..... 343/767
2081559 2/1982 United Kingdom .

OTHER PUBLICATIONS

Greiser, "Coplanar Stripline Antenna", Microwave Journal, 10-76, pp. 47-49.

*Primary Examiner*—Eli Lieberman
*Assistant Examiner*—Michael C. Wimer
*Attorney, Agent, or Firm*—Pollock, Vande Sande and Priddy

[57] ABSTRACT

A microwave antenna has three rectangular conductive elements on the surface of an insulative board. The elements are arranged side-by-side and are separated from one another by longitudinal slots formed of non-conductive regions. Each element has a lateral slot that divides the element into two identical pads. The central element is fed at its slot with microwave energy, either by electrical contact with the periphery of the slot or capacitively from behind the slot. Microwave energy is supplied to the side elements from the central element by means of the longitudinal slots. In operation, microwave energy is propagated or received by the lateral slots to reinforce energy propagated or received by the conductive elements.

5 Claims, 4 Drawing Figures

PLURAL MICROSTRIP SLOT ANTENNA

BACKGROUND OF THE INVENTION

This invention relates to antennas, and more especially, to radar antennas such as for use in radar altimeters.

Conventional microwave antennas are of one of two forms: a horn antenna, or a planar or printed element antenna. Horn antennas are relatively large and heavy but produce a good match, that is, the proportion of microwave energy transmitted to that which is reflected by the antenna back into the system is high over a wide range of frequencies. The planar element antenna, however, has a good match at only a narrow range of frequencies, the proportion of reflected energy increasing rapidly at frequencies on either side of the ideal frequency. The advantages of the planar element antenna are that it is very compact, of light weight and relatively easy to manufacture at low cost.

BRIEF SUMMARY OF THE INVENTION

It is an object of the present invention to provide an antenna of the planar element kind that can be made with improved characteristics, having good matching over a wide range of frequencies.

According to one aspect of the present invention there is provided a microwave antenna having a microwave element provided by a planar electrically-conductive area, wherein said element includes an electrically non-conductive region within said area, said region defining a slot by which microwave energy can be propagated or received to reinforce energy propagated or received by the conductive area.

The element may be fed with microwave energy at the slot.

According to another aspect of the present invention a microwave antenna is provided by a planar electrically-conductive area, said element including an electrically non-conductive region within said conductive area that defines a slot by which microwave energy can be fed to or received from the electrically-conductive area.

Microwave energy may be fed to or received from the slot by electrical contact with the element at the periphery of the slot, or capacitively from beneath the slot. The antenna may include a plurality of microwave elements and, in this respect, microwave energy may be fed to a first element, microwave energy from the first element being supplied to others of the elements by a further slot or slots.

A microwave antenna assembly used in an aircraft radar altimeter, in accordance with the present invention, will now be described, by way of example, with reference to the accompanying drawings.

DETAILED DESCRIPTION

Figure 1:
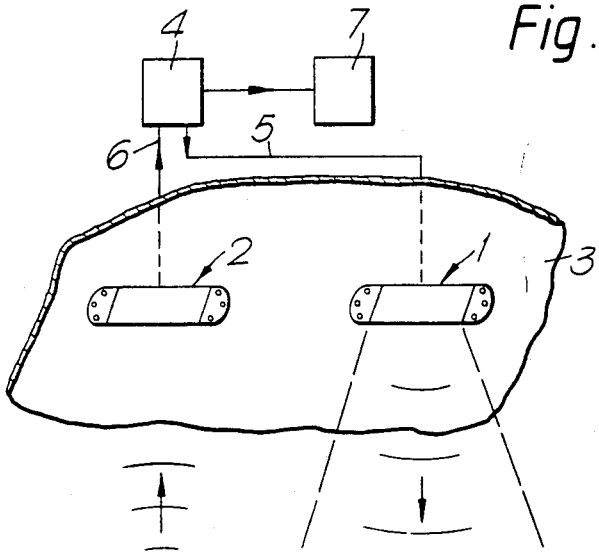
FIG. 1 shows schematically an aircraft radar altimeter system.

With reference to FIG. 1, there is shown an aircraft radar altimeter system including a transmitting antenna assembly 1 and an identical receiving antenna assembly 2 bolted to the underside of the aircraft fuselage 3. A transmitter/receiver unit 4, mounted in the aircraft, supplies microwave signals along the line 5 to the transmitting antenna assembly 1, and receives, on line 6 signals from the other antenna assembly 2 in accordance with the microwave energy reflected to the receiving assembly from the ground beneath the aircraft. By measurement, in the usual way, of the time interval between transmitted and received signals, the unit 4 calculates the height of the aircraft above ground and supplies suitable signals to an altimeter indicator 7 in the aircraft cockpit.

The transmitting and receiving assemblies 1 and 2 will now be described in greater detail with reference to FIGS. 2 and 3. The assemblies 1 and 2 each have a rigid aluminum backing plate 10 of generally rectangular shape, with rounded ends. The plate 10 is about 145 mm long by 75 mm wide and is provided with countersunk holes 11 at its ends for use in mounting the assembly. The plate is about 5 mm thick at its ends, the central region being cut away on one surface to form a central recess 12 about 90 mm long that is of reduced thickness. The central recess 12 receives the antenna array board 20 the forward surface 21 of which is flush with the exposed surface at the ends of the backing plate 10.

The antenna array board 20 is of a fibreglass-loaded Teflon or other stripline or microstrip laminate and carries on its forward surface 21 a planar antenna array 22 formed by a coating of copper metal. The array 22 is divided into three elements 23, 24 and 25 separated from one another by two longitudinal slots 26 and 27 which extend across the array 22 leaving narrow lateral conductive tracks 28 at the edges of the elements. Each of the elements 23, 24 and 25 is itself of rectangular shape, comprising two square conductive pads 30 and 31, 32 and 33, and 34 and 35 with substantially uninterrupted edges which are separated from one another by slots 36, 37 and 38 respectively. The slots 36 to 38 extend laterally of each element 23, 24 and 25 that is, longitudinally of the array 22, leaving narrow conductive tracks 39 at both ends of the slots, linking the two pads 30 to 35 respectively of each element.

The antenna array 22 is located approximately centrally within the board 20, being about 80 mm long by 50 mm wide. Each of the three elements 23 to 25 is about 25 mm wide, the lateral slots 36 to 38 being about 5 mm wide.

The rear surface 40 of the board 20 is entirely covered by a copper layer 41. The board 20 is provided with a small central aperture 42 that is aligned with the edge of one of the pads 32 of the central element 24, close to the slot 37. The aperture 42 in the board 20 is aligned with a larger aperture 50 in the backing plate 10 through which extends the end of a screened cable 43. The central conductor 44 of the cable projects through the aperture 42 in the board and is soldered to the copper pad 32. The cable 43 is secured with the rear surface of the backing plate 10 by means, for example, of a TNC connector.

The antenna array board 20 may be readily made from a board that is coated on both sides with a layer of copper. The copper is removed (by photo-etching or abrasion) from those regions which are to be non-conductive so as to produce the array 22 on the forward surface 21.

A protective layer or radome 52, such as of PTFE, is applied over the forward surface 21 of the assembly 1 to protect the copper regions from corrosion.

A signal at 4300 MHz is supplied via the cable 43 to the edge of the central slot 37. The slot 37 feeds the pads 32 and 33 on either side, the pads thereby propagating radiation in the usual way and this being reinforced by propagation directly from the slot. Feeding via the slot 37 can improve the matching of the antenna, giving a higher proportion of transmitted to reflected power over a wider range of frequencies. The propagation directly from the slot 37 also improves the characteristics of the antenna.

The longitudinal slots 26 and 27 on either side of the central element 24 serve to feed the other elements 23 and 25 which in turn propagate energy both from their conductive pads 30 and 31, and 34 and 35, and from their lateral slots 36 and 38. It will be appreciated that the side elements 23 and 24 could be omitted or that additional elements could be coupled in the array by the use of similar slots.

Figure 4:
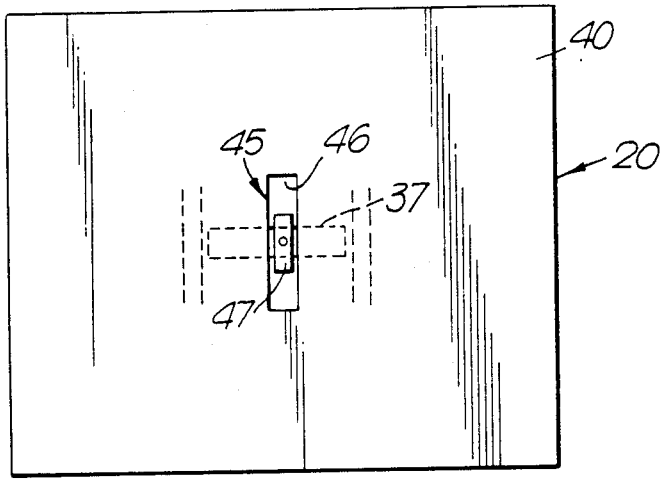
FIG. 4 is a view of the rear surface of a part of an alternative antenna assembly.

Instead of feeding the slot 37 by direct electrical contact around the periphery, capacitive coupling may be used. In this arrangement the rear surface 40 of the board 20 is modified as shown in FIG. 4 by removing copper from a central region 45 to form a non-conductive rectangular area 46 within which there is left a rectangular conductive island 47. The rectangular area 46 extends laterally of the board 20, being about 15 mm long. The conductive island 47 is located to underlie and traverse the slot 37 in the central element 24, formed on the forward surface 21 of the board 20. Connection is made to the island 47 by a cable similar to that referred to above, the signal supplied to the conductive island 47 capacitively feeding the slot 37.

By capacitively coupling the antenna array 22 from the rear side 40 of the board 20, the need for making direct electrical connection through the board is avoided. This enables the forward surface of the board to be smooth and uninterrupted by electrical connection and avoids the problems of sealing any holes made through the board.

The shape and size of the antenna elements are dictated by the nature of the desired propagated radiation and they need not necessarily be of the shape and size described above. Passive elements taking the form of strips or slots could be added to the array 22 to act as secondary radiators for the purpose of shaping the radiation patterns or improving other electrical features of the antenna.

Figure 2:
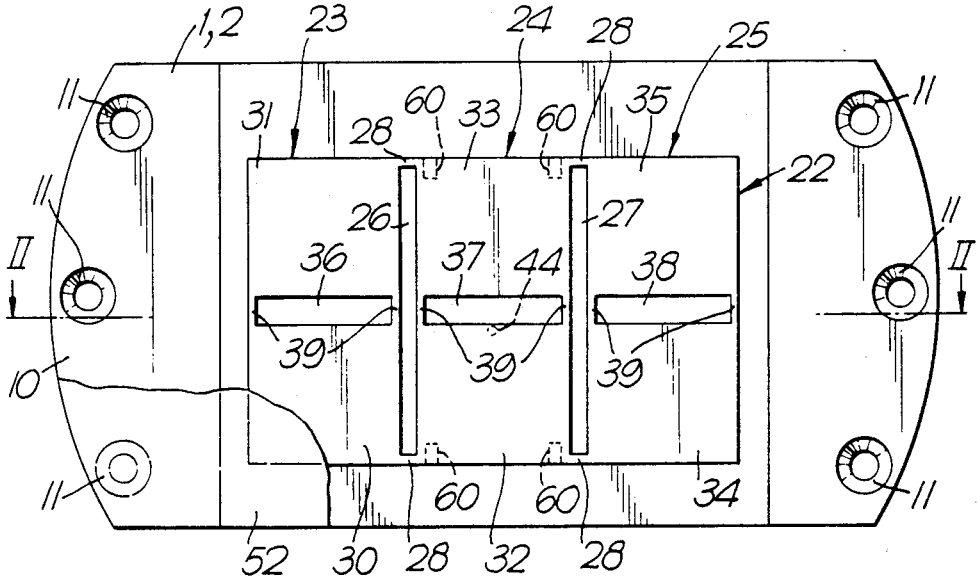
FIG. 2 is a view of the forward surface of the antenna assembly.
Figure 3:
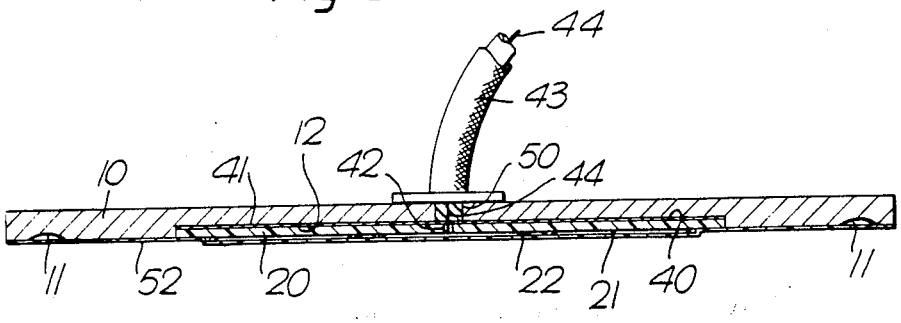
FIG. 3 is a sectional view of the assembly along the line III—III of FIG. 2.

To control the power division between the elements 23, 24 and 25, slots 60 can be cut into the elements 32 and 33 as shown by the broken lines in FIG. 2.

The receiving antenna assembly 2 is identical with the transmitting antenna assembly 1 described above.

What I claim is:

1. A microwave antenna having a first microwave element comprising an insulative substrate having a front surface and a rear surface, two substantially identical planar electrically-conductive areas formed on said front surface, said conductive areas having substantially uninterrupted boundaries and being effectively electrically insulated from said rear surface, and an electrically nonconductive region extending laterally between said two areas, said nonconductive region defining a first slot by which microwave energy is propagated or received to reinforce energy propagated from or received by said conductive areas, and at least one further microwave element substantially identical to said first microwave element and separated from said first microwave element by at least one further slot arranged orthogonally of said first slot such that microwave energy is supplied between said first element and said further element via said further slot, and means for feeding said antenna with microwave energy at said first slot.

2. A microwave antenna according to claim 1 wherein said means for feeding said antenna with microwave energy includes an electrical conductor that extends through said substrate from the rear surface of the substrate into contact with one of said electrically-conductive areas close to said first slot.

3. A microwave antenna according to claim 1 wherein said electrically-conductive areas are substantially square in shape.

4. A microwave antenna according to claim 1, including capacitive means coupled capacitively with said first slot, by which microwave energy is fed to or received from said first slot.

5. In a radar altimeter of the kind comprising: means for generating microwave energy; a microwave antenna formed on the front surface of an insulative substrate; means for supplying said microwave energy to said antenna such that microwave energy is propagated from said antenna; means for receiving microwave energy reflected from a remote surface; and means for deriving an indication of the distance of said remote surface from said antenna on the basis of the time taken by said propagated microwave energy to travel said distance, the improvement wherein said microwave antenna includes a first microwave element comprising two substantially identical planar electrically-conductive areas formed on said front surface of said substrate, said conductive areas having substantially uninterrupted boundaries and being effectively electrically insulated from the rear surface of said substrate, and an electrically nonconductive region extending laterally between said two areas, said nonconductive region defining a first slot by which microwave energy is propagated or received to reinforce energy propagated from or received by said conductive areas, and at least one further microwave element substantially identical to said first microwave element and separated from said first microwave element by at least one further slot arranged orthogonally of said first slot such that microwave energy is supplied between said first microwave element and said further microwave element via said further slot, said first microwave element being fed with said microwave energy at said first slot.

* * * * *